United States Patent [19]

Mookherjee et al.

[11] 4,228,026

[45] Oct. 14, 1980

[54] 3-HYDROXY-1-(2,6,6-TRIMETHYL-1,3-CYCLOHEXADIEN-1-YL)-1-BUTANONE IN DETERGENTS

[75] Inventors: Braja D. Mookherjee, Holmdel; Richard A. Wilson, Westfield; Manfred H. Vock, Locust; Joaquin F. Vinals, Red Bank, all of N.J.; Jacob Kiwala, Brooklyn, N.Y.; Frederick L. Schmitt, Holmdel; Edward J. Granda, Englishtown, both of N.J.

[73] Assignee: International Flavors & Fragrances Inc., New York, N.Y.

[21] Appl. No.: 39,116

[22] Filed: May 15, 1979

Related U.S. Application Data

[60] Continuation-in-part of Ser. No. 942,573, May 17, 1978, abandoned, which is a division of Ser. No. 872,975, Jan. 27, 1978.

[51] Int. Cl.[2] ..... C11D 3/50; C11D 9/44

[52] U.S. Cl. ..... 252/174.11; 252/108; 252/522 A; 260/455 R; 426/538

[58] Field of Search ..... 252/174.11, 108, 522; 426/538; 260/455 R

[56] References Cited

FOREIGN PATENT DOCUMENTS 1391736 4/1975 United Kingdom .

*Primary Examiner*—Mayer Weinblatt

*Attorney, Agent, or Firm*—Arthur L. Liberman; Franklin D. Wolffe

[57] ABSTRACT

Processes and compositions are described for the use as detergent aroma imparting, augmenting or enhancing materials of 3-hydroxy-1-(2,6,6-trimethyl-1,3-cyclohexadien-1-yl)-1-butanone having the structure:

and perfume compositions containing same.

2 Claims, 4 Drawing Figures

FIG. I

I.R. SPECTRUM FOR EXAMPLE I

3-HYDROXY-1-(2,6,6-TRIMETHYL-1,3-CYCLOHEXADIEN-1-YL)-1-BUTANONE IN DETERGENTS

This application is a continuation-in-part of application for U.S. Letters Patent, Ser. No. 942,573, filed on May 17, 1978, now abandoned, which is a divisional of application for U.S. Letters Patent, Ser. No. 872,975, filed on Jan. 27, 1978.

BACKGROUND OF THE INVENTION

The present invention relates to novel compositions and processes using 3-hydroxy-1-(2,6,6-trimethyl-1,3-cyclohexadien-1-yl)-1-butanone to alter, modify, augment, or enhance the aroma of detergents or impart aroma to detergents.

There has been considerable work performed relating to substances which can be used to impart (modify, augment or enhance) fragrances to (or in) detergents. These substances are used to diminish the use of natural materials, some of which may be in short supply, and to provide more uniform properties in the finished product.

Floral, fruity, musky and tobacco aromas with rose notes and hay-like and menthane-like undertones are desirable in several types of perfume compositions, perfumed articles and colognes.

3-Hydroxy-1-(2,6,6-trimethyl-1,3-cyclohexadien-1-yl)-1-butanone, having the structure:

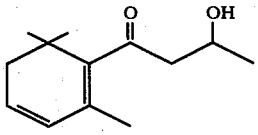

has heretofore been indicated by Ayyar, Cookson and Kagi, J. Chem. Soc., Perkin I, 1727 (1975) (Title: "Synthesis of Δ-Damascone [trans-1-(2,6,6-trimethylcyclohex-3-enyl)but-2-en-1-one] and beta-Damascenone [trans-1-(2,6,6-trimethylcyclohexa-1,3-dienyl) but-2-en-1-one]") to be useful as an intermediate in preparing "Damascenone" the "beta" isomer of which has the structure:

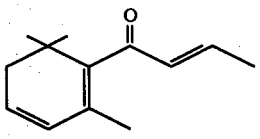

Ayyar, Cookson and Kagi do not, however, teach the usefulness of 3-hydroxy-1-(2,6,6-trimethyl-1,3-cyclohexadien-1-yl)-1-butanone for its organoleptic properties.

Schulte-Elte, U.K. Patent specification No. 1,391,736 discloses and claims a genus of compounds which include 3-hydroxy-1-(2,6,6-trimethyl-1,3-cyclohexadien-1-yl)-1-butanone and uses of their organoleptic properties but does not specifically teach any specific cyclohexadiene compounds per se or their uses for their organoleptic properties. Thus, U.K. Patent specification No. 1,391,736 states:

"The compounds to which the invention relates have the formula:

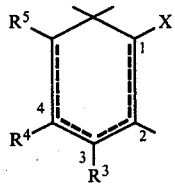

wherein:

X represents the group:

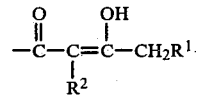

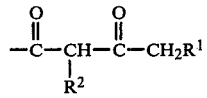

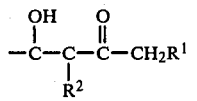

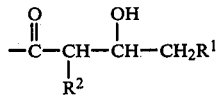

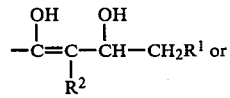

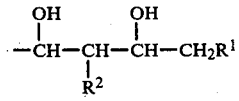

$R^1$, $R^2$, $R^3$, $R^4$ and $R^5$ may be the same or different, and each represents a hydrogen atom or a lower alkyl group having from 1 to 6 carbon atoms; and the ring is saturated or contains one edocyclic double bond in positions 1, 2, 3 or 4, or an exocyclic double bond in position 2, or two conjugated double bonds in positions 1 and 3 . . .

The new compounds of formula (I) include the following specific examples:

2,6,6-trimethyl-1-(1,3-dioxo-but-1-yl)-cyclohex-1-ene;

2-methylene-6,6-dimethyl-1-(1,3-dioxo-but-1-yl)-cyclohexane;

2,6,6-trimethyl-1-(3-hydroxy-butan-1-oyl)-cyclohex-1-ene;

2,6,6-trimethyl-1-(3-hydroxy-butan-1oyl)-cyclohex-2-ene;

2,6,6-trimethyl-1-(2-methyl-1,3-dioxo-but-1-yl)-cyclohex-1-ene;

2,6,6-trimethyl-1-(2-methyl-1,3-dioxo-but-1-yl)-cyclohex-2-ene;

2-methylene-6,6-dimethyl-1-(2-methyl-1,3-dioxo-but-1-yl)-cyclohexane;

2,6,6-trimethyl-1-(2-methyl-3-hydroxy-butan-1-oyl)-cyclohex-2-ene;

2-methylene-6,6-dimethyl-1-(2-methyl-3-hydroxy-butan-1-oyl)-cyclohexane;

2,6,6-trimethyl-1-(2-methyl-1,3-dihydroxy-but-1-yl)-cyclohex-2-ene;

2,6,6-trimethyl-1-(2-methyl-1,3-dihydroxy-but-1-yl)-cyclohex-1-ene;

2,6,6-trimethyl-1-(1,3-dioxo-but-1-yl)-cyclohexane;

2,6,6-trimethyl-1-(1,3-dihydroxy-but-1-yl)-cyclohexane;

2,6,6-trimethyl-1-(1,3-dihydroxy-but-1-yl)-cyclohex-2-ene; and 2,6,6-trimethyl-1-(1,3-dihydroxy-but-1-yl)-cyclohex-1-ene."

None of the exemplified compounds of U.K. Patent specification No. 1,391,736 has a chemical structure which can be considered by one having ordinary skill in the art to be even remotely similar to 3-hydroxy-1-(2,6,6-trimethyl-1,3-cyclohexadien-1-yl)-1-butanone.

A sulfur analogue of 3-hydroxy-1-(2,6,6-trimethyl-1,3-cyclohexadien-1-yl)-1-butanone, which sulfur analogue has the structure:

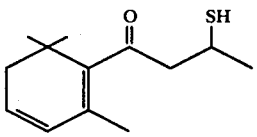

is disclosed as having useful organoleptic properties in U.S. Pat. No. 3,979,422. The organoleptic properties of the compound having the structure:

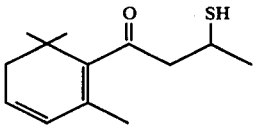

are different in kind from the organoleptic properties of 3-hydroxy-1-(2,6,6-trimethyl-1,3-cyclohexadien-1-yl)-1-butanone having the structure:

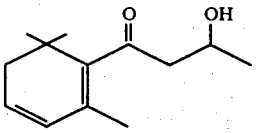

and, the properties of 3-hydroxy-1-(2,6,6-trimethyl-1,3-cyclohexadien-1-yl)-1-butanone are unexpectedly and unobviously advantageous insofar as the taste and aroma nuances are concerned and further insofar as the intensity and lasting power is concerned.

THE INVENTION

Figure 1:
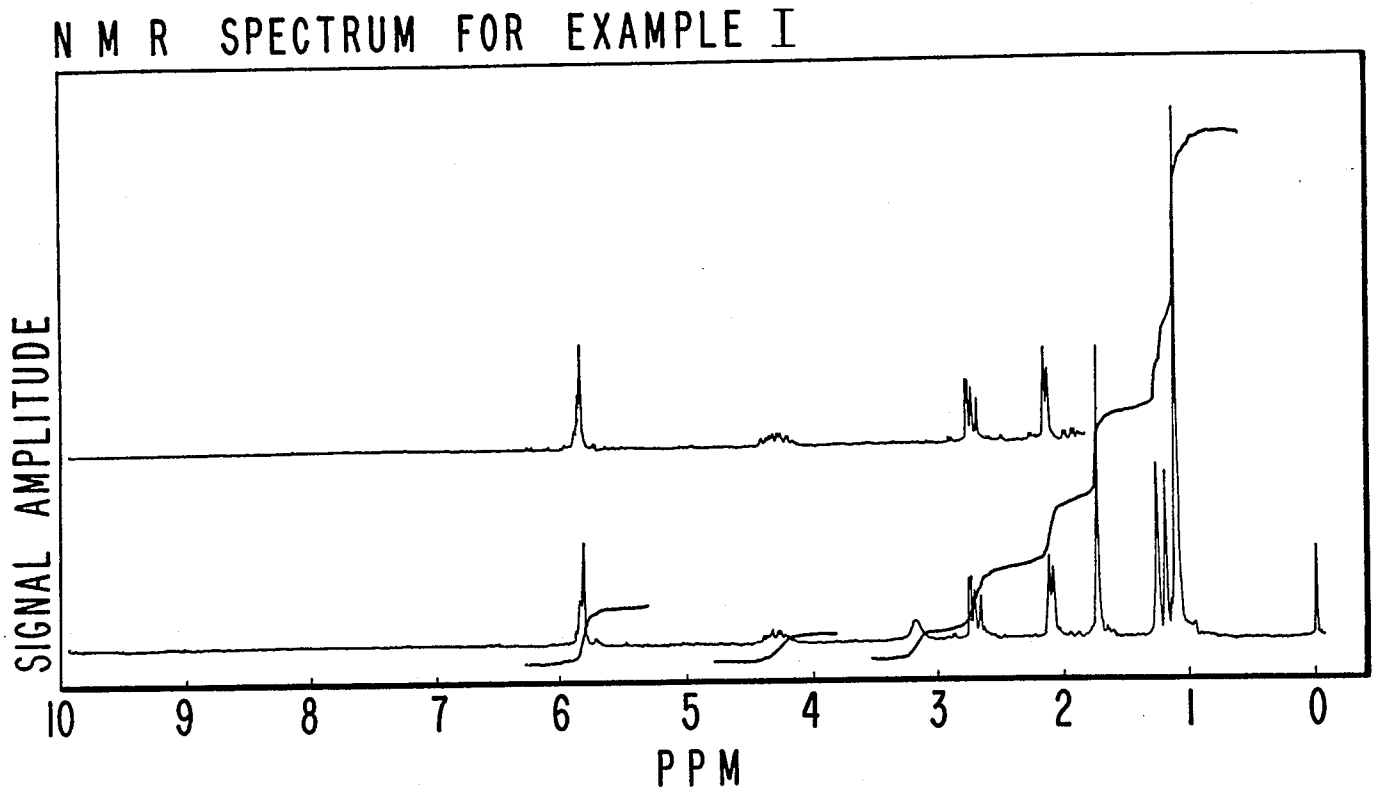
FIG. 1 is the nuclear magnetic resonance (NMR) spectrum for 3-hydroxy-1-(2,6,6-trimethyl-1,3-cyclohexadien-1-yl)-1-butanone produced according to Example I.

It has now been discovered that novel solid and liquid detergent compositions having floral, fruity, musky and tobacco aromas with rose and grape notes and hay-like and menthane-like undertones may be provided by the utilization of 3-hydroxy-1-(2,6,6-trimethyl-1,3-cyclohexadien-1-yl)-1-butanone having the formula:

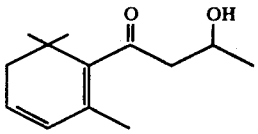

in detergents; that is, anionic, cationic and nonionic solid and liquid detergents including soaps.

3-Hydroxy-1-(2,6,6-trimethyl-1,3-cyclohexadien-1-yl)-1-butanone may be produced according to the procedure set forth by Ayyar Cookson and Kagi at pages 1727–1736 of J. Chem. Soc. Perkin I (1975) (Title: "Synthesis of -Damascone[trans-1-(2,6,6-trimethylcyclohex-3-enyl)but-2-en-1-one] and beta-Damascone[trans-1-(2,6,6-trimethylcyclohexa-1,3-dienyl)but-2-en-1-one]") (see particularly column 1 at page 1735, first paragraph).

The 3-hydroxy-1-(2,6,6-trimethyl-1,3-cyclohexadien-1-yl)-1-butanone and one or more auxiliary perfume ingredients, including, for example, alcohols, ketones, carboxylic acid esters, dialkyl ethers, aldehydes, nitriles, cyclic esters (lactones), alkenyl alkyl ethers and natural essential oils, may be admixed so that the combined odors of the individual components produce a pleasant and desired fragrance, particularly and preferably in rose fragrances. Such perfume compositions usually contain (a) the main note or the "bouquet" or foundation stone of the composition; (b) modifiers which round off and accompany the main note; (c) fixatives which include odorous substances which lend a particular note to the perfume throughout all stages of evaporation and substances which retard evaporation; and (d) topnotes which are usually low-boiling, fresh-smelling materials.

In perfume compositions, it is the individual components which contribute to their particular olfactory characteristics, however the over-all sensory effect of the perfume composition will be at least the sum total of the effects of each of the ingredients. Thus, the 3-hydroxy-1-(2,6,6-trimethyl-1,3-cyclohexadien-1-yl)-1-butanone can be used to alter, modify or enhance the aroma characteristics of a perfume composition, for example by utilizing or moderating the olfactory reaction contributed by other ingredients in the composition.

The amount of 3-hydroxy-1-(2,6,6-trimethyl-1,3-cyclohexadien-1-yl)-1-butanone of our invention which will be effective in perfume compositions as well as in anionic, cationic and nonionic solid and liquid detergents depends on many factory, including the other ingredients, their amounts and the effects which are desired. It has been found that perfume compositions containing as little as 0.01% of 3-hydroxy-1-(2,6,6-trimethyl-1,3-cyclohexadien-1-yl)-1-butanone or even less (e.g. 0.005%) can be used to impart a floral, fruity, tobacco aroma with rose note and hay, menthane undertones to soaps, cosmetics and other products. The amount employed can range up to 70% of the fragrance components and will depend on considerations of cost, nature of the end product, the effect desired on the finished product and the particular fragrance sought.

The 3-hydroxy-1-(2,6,6-trimethyl-1,3-cyclohexadien-1-yl)-1-butanone of our invention is useful as an olfactory component in anionic, nonionic and cationic solid and liquid detergents and soaps, space odorants and deodorants, perfumes, colognes, toilet water, bath preparations, such as lacquers, brilliantines, pomades and shampoos; cosmetic preparations, such as creams, deodorants, hand lotions and sun screens; powders, such as talcs, dusting powders, face powders and the like. When used as an olfactory component as little as 0.005% of 3-hydroxy-1-(2,6,6-trimethyl-1,3-cyclohexadien-1-yl)-1-butanone will suffice to impart an intense musky and floral aroma to the detergent formulation. Generally, no more than 3.0% of 3-hydroxy-1-(2,6,6-trimethyl-1,3-cyclohexadien-1-yl)-1-butanone based on the ultimate end product, is required in the detergent. The preferred range of use in the solid or liquid anionic, cationic or nonionic detergent is from 0.005% up to 0.5% by weight of the detergent.

In addition, the perfume composition of fragrance composition of our invention can contain a vehicle, or carrier for the 3-hydroxy-1-(2,6,6-trimethyl-1,3-cyclohexadien-1-yl)-1-butanone. The vehicle can be a liquid such as non-toxic alcohol, a non-toxic glycol or the like. The carrier can also be an absorbent solid, such as a gum e.g., gum arabic, or components for encapsulating the composition (such as gelatin).

Example I serves to illustrate a process for preparing the 3-hydroxy-1-(2,6,6-trimethyl-1,3-cyclohexadien-1-yl)-1-butanone of our invention. The examples following serve to illustrate the invention and the invention is to be considered restricted thereto only as indicated in the appended claims.

All parts and percentages given herein are by weight unless otherwise specified.

EXAMPLE I

Preparation of 3-Hydroxy-1-(2,6,6-Trimethyl-1,3-Cyclohexadien-1-yl)-1-Butanone Reactions:

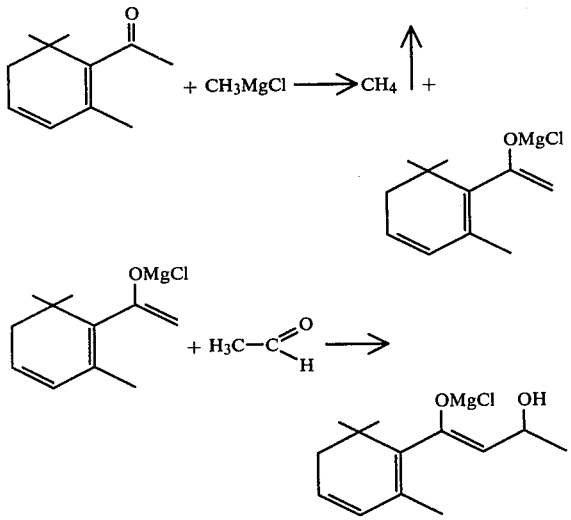

-continued

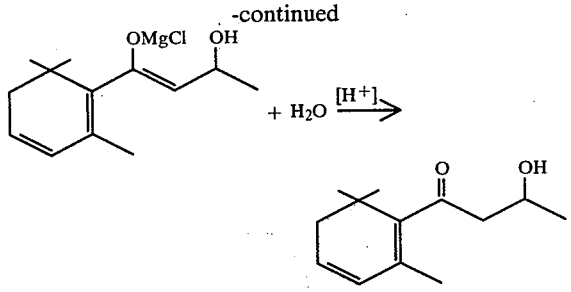

Into a 2-liter reaction flask equipped with a mechanical stirrer, cooling bath, 250 ml addition funnel, nitrogen purge, water-cooled condenser, gas bubbler and thermometer, is magnesium chloride in tetrahydrofuran. 200 Grams (1.22 moles) of 2,6,6-trimethyl-1-acetylcyclohexa-1,3-diene are added dropwise from the addition funnel at a rate sufficient to produce methane. Cooling is applied as necessary to maintain the reaction temperature between 30° and 35° C. Following completion of the addition of the 2,6,6-trimethyl-1-acetylcyclohexa-1,3-diene, the reaction mass is stirred until no further methane is evolved. The reaction mass is then cooled to a temperature in the range of from 0° C. to 5° C., and 59 grams of acetaldehyde is added dropwise with stirring while maintaining the reaction mass temperature at about 10° C. The reaction is slightly exothermic. 15 Minutes after the completion of the addition of acetaldehyde, acetic acid is added dropwise while maintaining the temperature of the reaction mass at about 10° C. Following the addition of acetic acid, the reaction mass is permitted to reach room temperature. The reaction mass is then washed into a separatory funnel with water to dissolve the salt therein. The resulting organic layer is washed with saturated sodium chloride, saturated sodium bicarbonate, and then saturated sodium chloride. The washed organic layer is then dried over anhydrous magnesium sulfate and concentrated on a rotovap yielding 256 grams of residue.

The resulting hydroxyketone having the structure:

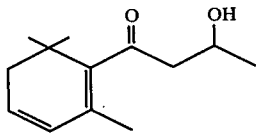

is distilled under vacuum in order to separate it from other impurities. 70 Grams of the distilled material is combined with 80 grams of Primol® and distilled under 0.25–0.60 mm Hg pressure into nine fractions. The distillation data is as follows:

| Vapor Temp. | Liquid Temp. | Weight of Fraction | Fraction # |
|---|---|---|---|
| 22°–40.5° | 24°–85° | 3.96 | 1 |
| 40.0 | 94 | 6.50 | 2 |
| 44 | 105 | 2.90 | 3 |
| 88 | 114 | 4.24 | 4 |
| 89.5 | 116.5 | 4.50 | 5 |
| 90.75 | 120.0 | 8.01 | 6 |
| 93.0 | 128.0 | 8.34 | 7 |
| 88.5 | 147.0 | 7.93 | 8 |
| 87.0 | 147.0 | 3.51 | 9 |

Fraction #6 is found to be substantially pure and is submitted for mass spectral, NMR IR and UV analyses.

Figure 2:
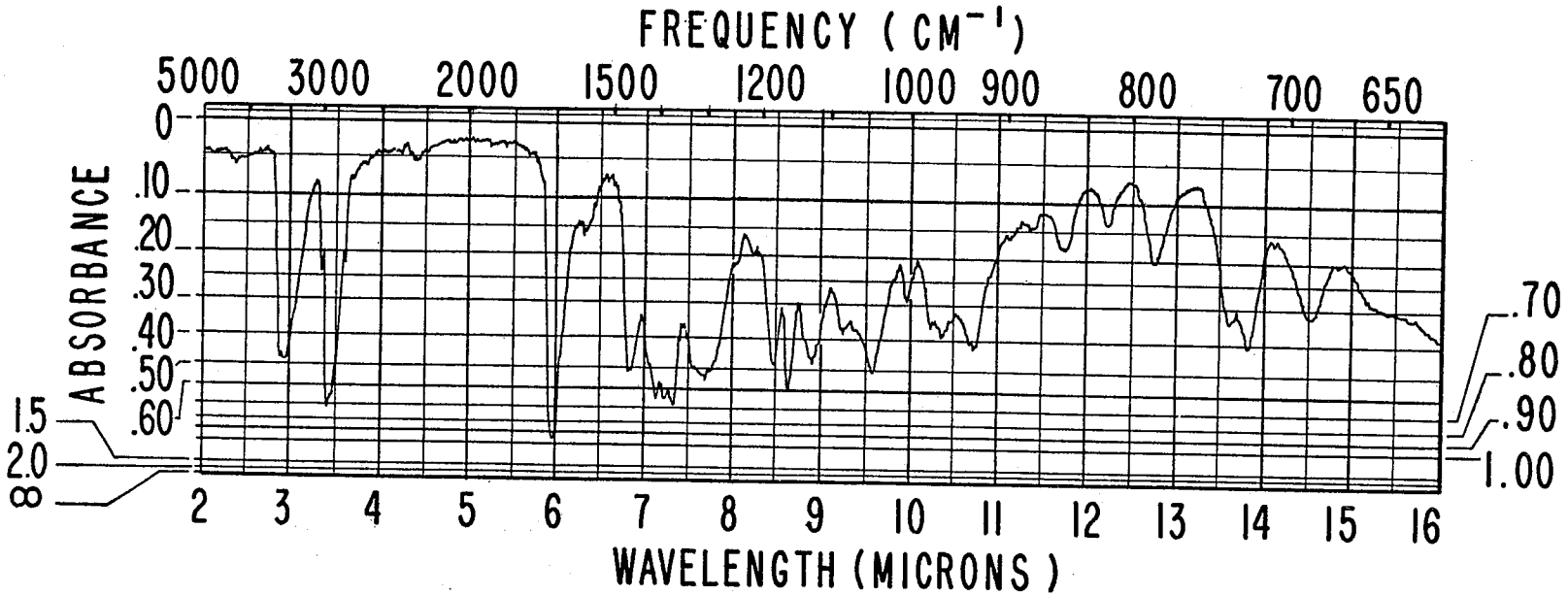
FIG. 2 is the infrared (IR) spectrum for 3-hydroxy-1-(2,6,6-trimethyl-1,3-cyclohexadien-1-yl)-1-butanone produced according to Example I.
Figure 3:
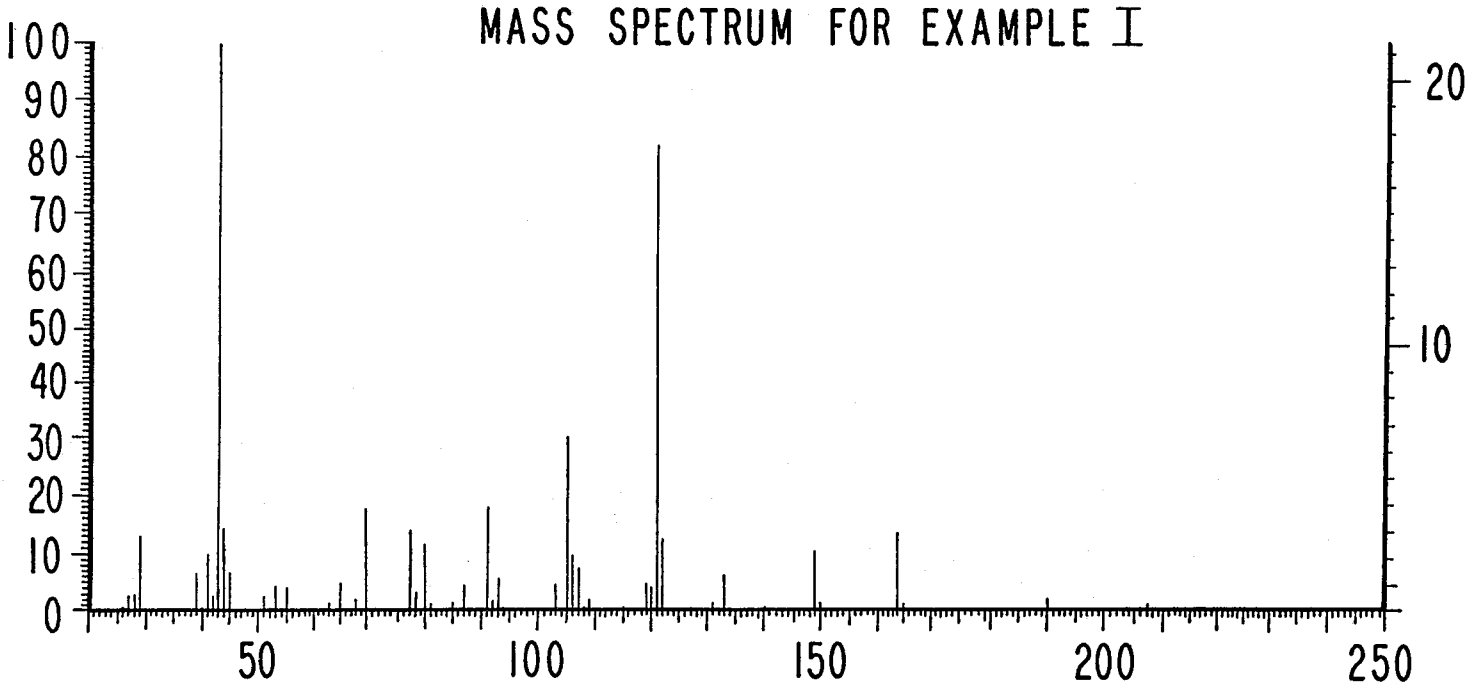
FIG. 3 is the mass spectrum (MS) for 3-hydroxy-1-(2,6,6-trimethyl-1,3-cyclohexadien-1-yl)-1-butanone produced according to Example I.
Figure 4:
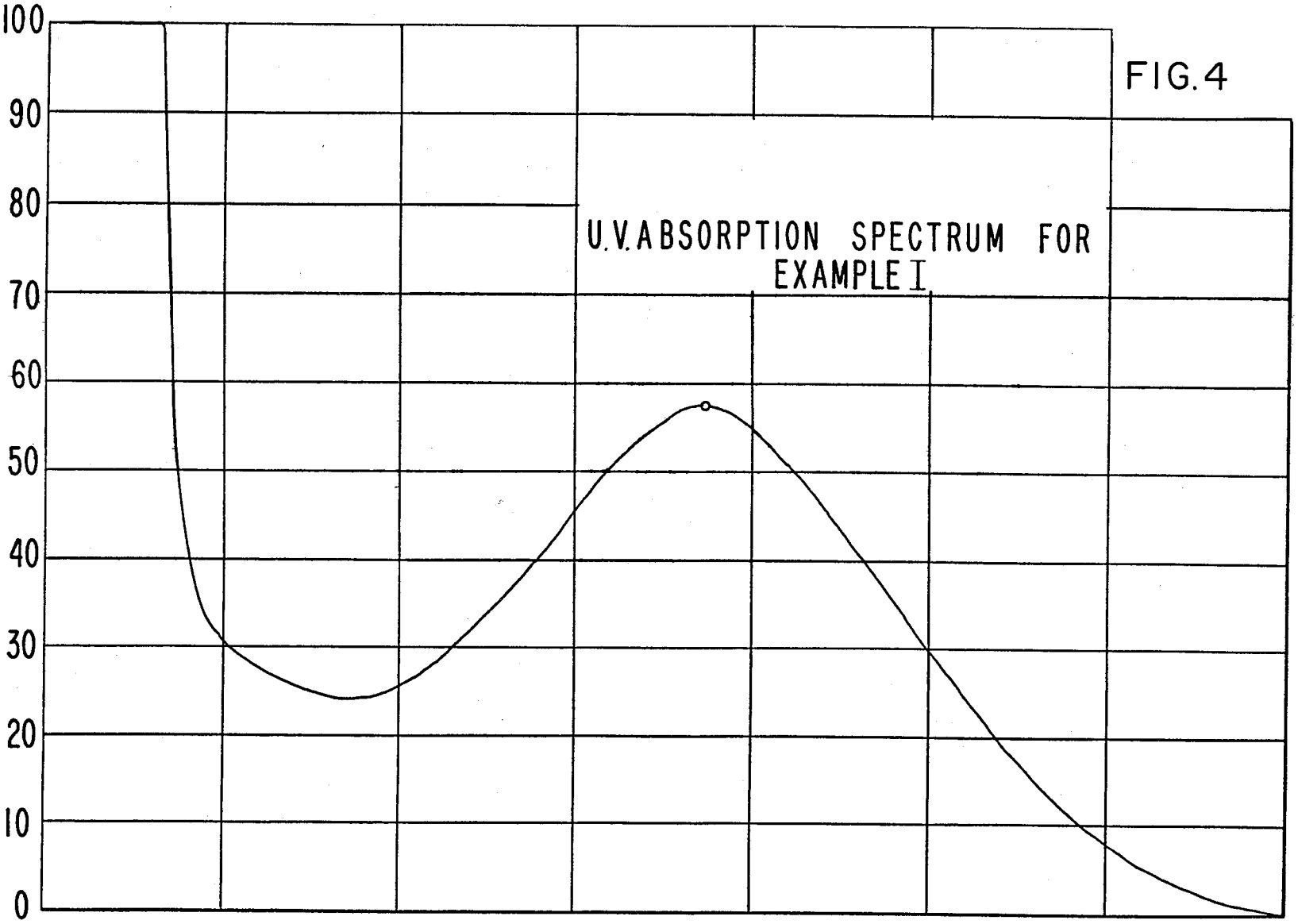
FIG. 4 is the ultraviolet (UV) absorption spectrum for 3-hydroxy-1-(2,6,6-trimethyl-1,3-cyclohexadien-1-yl)-1-butanone produced according to Example I, using a methanol solvent.

The NMR spectrum is set forth in FIG. 1. The infrared spectrum is set forth in FIG. 2. The mass spectrum is set forth in FIG. 3. The ultraviolet absorption spectrum (using a methanol solvent) is set forth in FIG. 4. $\lambda_{max}=277$ nm. $E_{1\,cm}^{1\%}=176.65$ in methyl alcohol. The NMR analysis is as follows:

| Chem. Shift | Signal Type | Assignment | Quant. |
|---|---|---|---|
| 1.10 | S | 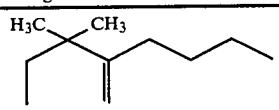 | 6H |
| 1.23 | d | 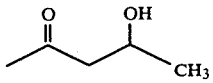 | 3H |
| 1.74 | S | 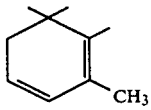 | 3H |
| 2.11 | d | 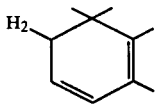 | 2H |
| 2.71 | m | 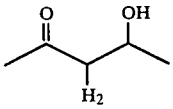 | 2H |
| 3.20 | Broad | 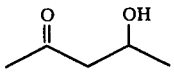 | 1H |
| 4.30 | M | 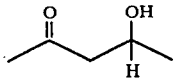 | 1H |
| 5.82 | M | 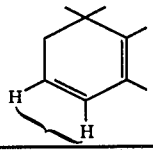 | 2H |

The infrared analysis is as follows:

| | |
|---|---|
| 3400–3500 $cm^{-1}$ | strong |
| 3000 | moderate |
| 2950 | strong |
| 2800 | moderate |
| 1680 | strong |
| 1580 | weak |
| 1460 | strong |
| 1360–1400 | strong |
| 1280–1330 | strong |
| 1185 | moderate |
| 1160 | strong |
| 1125 | moderate |
| 1040 | moderate |
| 1005 | moderate |
| 935–980 | moderate |
| 850 | weak |
| 820 | weak |
| 783 | moderate |
| 723–737 | moderate |
| 690 | moderate |

The mass spectral analysis is as follows:

| M/E | Relative Intensity |
|---|---|
| 43 | 100 |

-continued

| M/E | Relative Intensity |
|---|---|
| 69 | 18 |
| 77 | 13 |
| 79 | 11 |
| 91 | 18 |
| 105 | 30 |
| 121 | 81 |
| 122 | 10 |
| 149 | 9 |
| 164 | 12 |
| 190 | 2 |
| 208p | 1 |

EXAMPLE II

Rose Formulation

To demonstrate the use of 3-hydroxy-1-(2,6,6-trimethyl-1,3-cyclohexadien-1-yl)-1-butanone in a rose formulation, the following formula is provided:

| Ingredient | Parts by Weight |
|---|---|
| Phenylethyl alcohol | 200 |
| Geraniol | 400 |
| Trichloromethylphenyl carbinyl acetate | 20 |
| Phenylethyl acetate | 60 |
| Undecylenic aldehyde (10% in diethyl phthalate) | 5 |
| n-Nonyl aldehyde (10% in diethyl phthalate) | 2 |
| Musk ketone | 10 |
| Musk ambrette | 10 |
| Eugenol phenyl acetate | 20 |
| Citronellol | 100 |
| Vanillin (10% in diethyl phthalate) | 6 |
| Eugenol | 30 |
| Citronellyl formate | 30 |
| Geranyl acetate | 10 |
| Linalool | 40 |
| Geranyl phenyl acetate | 50 |
| Cis beta, γ-hexenyl acetate | 2 |
| 3-hydroxy-1-(2,6,6-trimethyl-1,3-cyclohexadien-1-yl)-1-butanone prepared according to Example I | 5 |
| | 1000 |

The addition of 0.5% of 3-hydroxy-1-(2,6,6-trimethyl-1,3-cyclohexadien-1-yl)-1-butanone lends a great deal of strength and character to the rose fragrance. It contributes floralcy, musk-like nuances and fruitiness with hay-like and menthane-like undertones.

At lower concentrations (0.01%) its contribution is more subtle, however, it gives an interesting natural effect.

This product may normally be used from approximately 0.01% to 10% in perfume composition. For special effects, however, higher concentrations (50%) can be used.

EXAMPLE III

Preparation of a Soap Composition

100 Grams of soap chips are produced according to Example 5 of U.S. Pat. No. 4,058,487 issued on Nov. 15, 1977, as follows:

The sodium salt of an equal mixture of $C_{10}/C_{14}$ alkane sulfonates (95% active), 40 lbs., is dissolved in a mixture of 80 lbs. of anhydrous isopropanol and 125 lbs. of deionized water at 150° F. In this mixture is dissolved 10 lbs. of partially hydrogenated coconut oil fatty acids and 15 lbs. of sodium mono-$C_{14}$-alkyl maleate, and the pH of this solution is adjusted to 6.0 by the addition of a small amount of a 50% aqueous solution of NaOH. The isopropanol is distilled off and the remaining aqueous solution is drum dried. The resulting solid actives are then blended in a chip mixer with 10 lbs. water, 0.2 lb. titanium hydroxide and 0.75 lb. of the perfume composition of Example II. The chips are then plodded into logs, cut to size and finally stamped into bars, having a pH of approximately 6.9.

The perfumed soap manifests an excellent rose and musky character with excellent sweet, floral and fruity notes.

EXAMPLE IV

Preparation of a Detergent Composition

A total of 100 grams of a detergent powder prepared according to U.S. Pat. No. 4,058,472 and containing 5% by weight of the sodium salts of a mixture of sulfonated $C_{14}C_{18}$ alkyl catechol as a surface active component, the mixture being 60 parts by weight of mono-$C_{14}C_{18}$ alkyl catechol and 40 parts by weight of di-$C_{14}C_{18}$ alkyl catechol, 35% of sodium tetrapyrophosphate, 30% of sodium silicate, 20% of sodium carbonate, 3% of sodium carboxymethylcellulose and 7% of starch, is mixed with 0.15 grams of the perfume composition of Example II until a substantially homogeneous composition is obtained. This composition has an excellent rose aroma with sweet, musky, floral and fruity notes.

EXAMPLE V

Perfumed Liquid Detergent

Concentrated liquid detergents with floral, musky, fruity, tobacco-like fragrances having rose, hay and menthane undertones are prepared containing 0.10%, 0.15% and 0.20% of 3-hydroxy-1-(2,6,6-trimethyl-1,3-cyclohexadien-1-yl)-1-butanone prepared according to Example I. They are prepared by adding and homogeneously mixing the appropriate quantity of 3-hydroxy-1-(2,6,6-trimethyl-1,3-cyclohexadien-1-yl)-1-butanone in the liquid detergents. The detergents all possess a floral, fruity, musky, tobacco-like fragrance having rose, hay and menthane undertones, the intensity increasing with greater concentrations of 3-hydroxy-1-(2,6,6-trimethyl-1,3-cyclohexadien-1-yl)-1-butanone.

EXAMPLE VI

Preparation of Soap Composition

One hundred grams of soap chips produced according to Example V of U.S. Pat. No. 4,058,487 are mixed with one gram of 3-hydroxy-1-(2,6,6-trimethyl-1,3-cyclohexadien-1-yl)-1-butanone until a substantially homogeneous composition is obtained. The perfumed soap composition manifests an excellent floral, musky, fruity, tobacco-like fragrance having rose, hay and menthane undertones.

EXAMPLE VII

Preparation of a Detergent Composition

A total of 100 g of a detergent powder prepared as in Example VI, supra, is mixed with 0.15 g of the 3-hydroxy-1-(2,6,6-trimethyl-1,3-cyclohexadien-1-yl)-1-butanone of Example I until a substantially homogeneous composition is obtained. This composition has an excellent floral, fruity, musky, tobacco-like fragrance having rose, hay and menthane undertones.

Materials having the chemical structures:

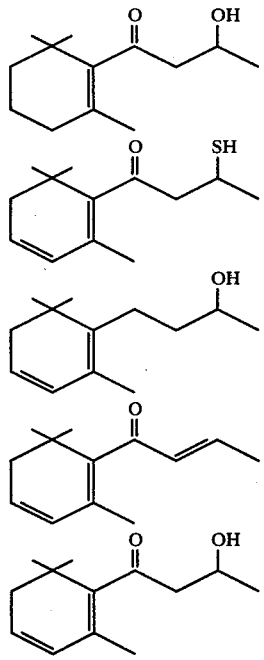

are comparatively evaluated from an organoleptic standpoint and the outcomes of these evaluations are as follows:

The compound having the structure (v) was found to be sweeter, more floral, animal-like, dried fruity and musky than compounds (i) or (ii). Materials (i) had somewhat of a rose character but was not as strong as compound (v) and did not last nearly as long on the blotter. Material (ii) was oniony and rather unpleasant with an orris note but was the least pleasant of materials evaluated. Also material (ii) was not as long lasting as material (v). Material (iii) was not as strong as material (v) but had a different type of floralcy (memosa, violet leaf) and is preferred over material (v) insofar as the floralcy is concerned. Material (iv) is far superior odor wise to all materials here evaluated but does not have the musk aroma. Furthermore, material (v) is longer lasting on blotters by a few hours. These results are born out in a comparison of these materials in the following perfume formulation.

Rose Formulation

To demonstrate the use of 3-hydroxy-1-(2,6,6-trimethyl-1,3-cyclohexadien-1-yl)-1-butanone in a rose formulation and comparison thereof with materials (i), (ii), (iii) and (iv) the following formulae were provided:

| Ingredient | Parts by Weight | | | | |
|---|---|---|---|---|---|
| | A | B | C | D | E |
| Phenylethyl alcohol | 200 | 200 | 200 | 200 | 200 |
| Geraniol | 400 | 400 | 400 | 400 | 400 |
| Trichloromethylphenyl carbinyl acetate | 20 | 20 | 20 | 20 | 20 |
| Phenylethyl acetate | 60 | 60 | 60 | 60 | 60 |
| Undecylenic aldehyde (10% in diethyl phthalate) | 5 | 5 | 5 | 5 | 5 |
| n-Nonyl aldehyde (10% in diethyl phthalate) | 2 | 2 | 2 | 2 | 2 |
| Musk ketone | 10 | 10 | 10 | 10 | 10 |
| Musk ambrette | 10 | 10 | 10 | 10 | 10 |
| Eugenol phenyl acetate | 20 | 20 | 20 | 20 | 20 |

-continued

| Ingredient | Parts by Weight A | B | C | D | E |
|---|---|---|---|---|---|
| Citronellol | 100 | 100 | 100 | 100 | 100 |
| Vanillin (10% in diethyl phthalate) | 6 | 6 | 6 | 6 | 6 |
| Eugenol | 30 | 30 | 30 | 30 | 30 |
| Citronellyl formate | 30 | 30 | 30 | 30 | 30 |
| Geranyl acetate | 10 | 10 | 10 | 10 | 10 |
| Linalool | 40 | 40 | 40 | 40 | 40 |
| Geranyl phenyl acetate | 50 | 50 | 50 | 50 | 50 |
| Cis beta, γ-hexenyl acetate | 2 | 2 | 2 | 2 | 2 |
| 3-hydroxy-1-(2,6,6-trimethyl-1,3-cyclohexadien-1-yl)-1-butanone (substance (V) | 5 | 0 | 0 | 0 | 0 |
| Material (i) | 0 | 5 | 0 | 0 | 0 |
| Material (ii) | 0 | 0 | 5 | 0 | 0 |
| Material (iii) | 0 | 0 | 0 | 5 | 0 |
| Material (iv) | 0 | 0 | 0 | 0 | 5 |
| TOTALS | 1000 | 1000 | 1000 | 1000 | 1000 |

Material (v) in formula a gave a very interesting floral, animal musky-like note which is far superior in perfumery value than the affect obtained in formula B or C from materials (i) and (ii) respectively. Material (i) gave a very weak effect which was not as long lasting as the effect in formula A by material (v). Material (ii) gave an unpleasant odor to the fragrance of formula C. Material (iii) on the other hand gave a very different effect; a very nice deep floral sweet memosa note to formula D. In formula E, material (iv) had to be used as 0.1% because of its greater strength. Material (iv) gave a very good rose effect in formula E which was far superior than the effects in formulae A, B, C or D. However, no musky effect was given in formula E.

Our conclusion is that material (v) is more esthetic and is longer lasting than materials (i) or (ii) and is the only material that has the musk aroma; but insofar as the floral notes are concerned, material (v) is not as effective as materials (iii) or (v).

A soap was prepared according to the procedure of Example III. The results for compound (v) were the same: the soaps and detergents all give a floral, fruity, tobacco-like fragrance with rose, hay undertones and strong musky nuances. In comparison with materials (i) and (ii), soaps and detergents containing material (v) are superior. Material (i) is quite weak whereas material (ii) has a oniony off odor which is not too esthetic. Materials (iii) and (iv) performed better than (i) or (ii) and (v). However, material (v) seems to be the longer lasting of all of the materials and is the only material that has the musk nuance.

The soap composition prepared according to Example III is prepared as follows:

100 grams of soap chips are produced according to Example V of U.S. Pat. No. 4,058,487 issued on Nov. 15, 1977, as follows:

The sodium salt of an equal mixture of $C_{10}/C_{14}$ alkane sulfonates (95% active), 40 lbs., is dissolved in a mixture of 80 lbs. of anhydrous isopropanol and 125 lbs. of deionized water at 150° F. In this mixture is dissolved 10 lbs. of partially hydrogenated coconut oil fatty acids and 15 lbs. of sodium mono-$C_{14}$-alkyl maleate, and the pH of this solution is adjusted to 6.0 by the addition of a small amount of a 50% aqueous solution of NaOH. The isopropanol is distilled off and the remaining aqueous solution is drum dried. The resulting solid actives are then blended in a chip mixer with 10 lbs. water, 0.2 lbs. titanium hydroxide and 0.75 lb. of the material to be tested, either (i), (ii), (iii), (iv) or (v). The chips are then plodded into logs, cut to size and finally stamped into bars, having a pH of approximately 6.9.

Thus, our conclusion is that based on the results set forth in the immediately preceding paragraph that substance (v) having the structure:

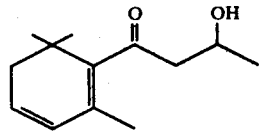

compared with each of substances (i), (ii), (iii) and (iv) having the structures, respectively:

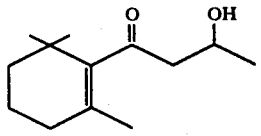

(i)

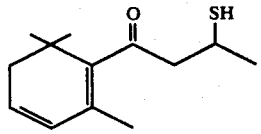

(ii)

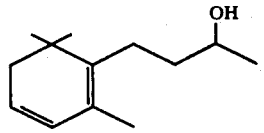

(iii)

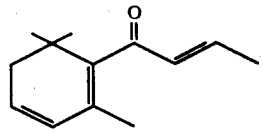

(iv)

has unexpected, unobvious and advantageous characteristics with regard to its augmenting and enhancing character of perfume aromas and also insofar as the strength of its organoleptic perfumery characteristics are concerned both in perfume compositions and in soaps, particularly in view of the musk nuances which it augments and imparts.

What is claimed is:

1. A process for augmenting or enhancing the aroma of a solid or liquid detergent which consists essentially of adding thereto from 0.005% up to 3.0% by weight of said detergent of 3-hydroxy-1-(2,6,6-trimethyl-1,3-cyclohexadien-1-yl)-1-butanone having the structure:

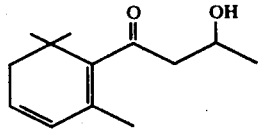

2. The process of claim 1 wherein the detergent is a soap, and the 3-hydroxy-1-(2,6,6-trimethyl-1,3-cyclohexadien-1-yl)-1-butanone is added in an amount of from 0.005% up to 0.5%.

* * * * *